US006237894B1

(12) United States Patent
Cotner et al.

(10) Patent No.: US 6,237,894 B1
(45) Date of Patent: May 29, 2001

(54) JACK HANDLE AND METHOD OF MANUFACTURING AND USING SAME

(76) Inventors: Patrick L. Cotner, 1105 N. St. Mary, Eunice, LA (US) 70535; Ronald L. Cotner, 113 Walnut Hill Rd., Derry, NH (US) 03038

( * ) Notice: Subject to any disclaimer, the term of this patent is extended or adjusted under 35 U.S.C. 154(b) by 0 days.

(21) Appl. No.: 09/195,001

(22) Filed: Nov. 18, 1998

(51) Int. Cl.[7] ..... B66F 1/00
(52) U.S. Cl. ..... 254/1; 254/DIG. 3
(58) Field of Search ..... 254/122, 126, 254/DIG. 3, 1; 74/543–547; 16/114 R; 279/143, 145

(56) References Cited

U.S. PATENT DOCUMENTS 3,451,655 * 6/1969 Scott ..... 254/122
4,893,785 * 1/1990 Rose ..... 254/126
4,943,034 * 7/1990 Wagnon ..... 254/122
5,161,782 * 11/1992 Huang ..... 254/126
5,301,389 * 4/1994 Engel et al. ..... 254/DIG. 3
5,638,577 * 6/1997 Gooding et al. ..... 16/114 R
5,657,964 * 8/1997 Yoshida ..... 254/122
5,771,516 * 6/1998 Huang ..... 254/122
5,865,499 * 2/1999 Keyser ..... 74/606 R
5,878,627 * 3/1999 McMurtrey ..... 254/DIG. 3
5,897,121 * 4/1999 Case ..... 254/DIG. 3

* cited by examiner

*Primary Examiner*—Robert C. Watson
(74) *Attorney, Agent, or Firm*—Davis & Bujold, P.L.L.C.

(57) ABSTRACT

A jack handle comprising an elongate cylindrical shaft having a first end and an opposed second end. The first end of the shaft supports a drive adaptor which is shaped to engage with a drive head of an electric, a pneumatic, a ratchet or an impact drive drill. The second end of the shaft has a bent-shaft adaptorwhich is bent at an angle substantially perpendicularto the longitudinal axis of the shaft, or otherwise configured to transmit rotational drive to a desired jack. During use, the drive is inserted into a U-shaped jack actuator coupler. The drive adaptor end is inserted and secured to the drive head, and the drill or other drive device is operated in a conventional manner to rotate the jack handle in a chosen rotational direction to raise or lower the jack as desired.

3 Claims, 6 Drawing Sheets

JACK HANDLE AND METHOD OF MANUFACTURING AND USING SAME

FIELD OF THE INVENTION

This invention relates to lifting devices in general and, more particularly, to a device for actuating a jack from a remote location.

BACKGROUND OF THE INVENTION

There are many types of lifting devices known in the prior art. For example, a pivoted lever (e.g. a pole supported by a rock) may be used to move or dislodge a heavy object. Other, more sophisticated lifting devices include pulley blocks, hand-chain hoists, and motor driven lifting systems such as cranes and elevators. Another type of lifting device is the jack. A jack is typically a portable, manually operated device for moving or lifting heavy loads or objects a short vertical distance. Jacks are frequently used, for example, to raise or lower one side of an automobile in order to facilitate the replacement of a flat tire.

There are many types of jacks well known in the art. Two types of jacks that require rotational actuation movement are a screw jack and a scissor jack—both have an input gear which must be rotated. Two types that use lever-like movement for actuation (that is, the up and down movement of a handle or lever) are a hydraulic jack and a rack-and-lever jack. Both types of jacks typically have some elements in common. These include a base plate or platform, which provides a ground support for the jack, a stand, which houses the inner movable components of the jack, a load bearing assembly, which supports and retains the load to be raised or lowered, and an actuator coupler, which receives the lever or handle by which the jack is operated.

Turning now to FIG. 1, a perspective view of a simplified screw jack, according to the prior art, is shown. A base plate 10 supports a stand 12. The stand 12 houses the internal components of the jack (not shown) which is actuated via an actuator coupler 14 (here, a square female connector). A handle 16, only partially shown in this Figure, engages with the actuator coupler 14. The handle 16 is rotated either clockwise or counter-clockwise to facilitate operation of the jack.

The internal components of the screw jack, which are not illustrated in further detail as such components are well known in the art, are not particularly relevant to the present invention. The handle 16 directly rotates a first gear, which has a center coupling assembly adapted to engage with a drive end of the handle. The first gear, in turn, rotates a gear assembly (according to a particular power transferring gear ratio as is well known in the art) which, in turn, rotates a first screw. That first screw then rotates a vertically oriented screw (which is typically integral with the load bearing assembly 18) which, in turn, moves axially with respect to the stand 12 (i.e. vertically up or down). Thus the load supported by the load bearing assembly 18 is either raised or lowered, as desired, depending upon the rotational direction of the handle 16. Because of the arrangement of the internal mechanism and the gear ratio, a single person, using the jack, is able to raise or lower a substantial load after numerous rotations of the handle.

Every manually operated jack requires some sort of actuating handle or lever to control operation thereof. Typically one end of the handle has a hand grip, and the other end has an actuator coupler adaptor that is shaped to engage with the actuator coupler provided on the jack so that a mating engagement between the actuator coupler adaptor of the handle and the actuator coupler of the jack is achieved to facilitate operation of the jack. As mentioned above, a screw jack might require a handle having a square male actuator coupler adaptor which mates with a similarly but oppositely shaped female actuator coupler 14.

A scissor jack, as well as some screw jacks, which typically have U-shaped actuator couplers, might require a "bent-shaft" adaptor (as discussed below in further detail). A prior art U-shaped actuator coupler is shown in FIG. 2.

As seen in FIG. 2, the U-shaped actuator coupler consists of a U-shaped bracket or actuator coupler 30 having a base plate 32 and two parallel side plates 34. Each side plate 34 has a circular void or aperture 36 formed therein near a center of the side plate. An actuator coupler shaft 38is connected to the base plate 32 on the side opposite the two side plates 34. The U-shaped actuator coupler shaft 38 is, in turn, permanently connected (e.g. threadedly engaged, welded, etc.) to the internal mechanism of the jack, for example, to a center of a gear.

To operate the U-shaped actuator coupler 30, a handle having a mating bent-shaft adaptor is utilized. Such a handle is diagrammatically shown in FIG. 3 (not to scale). A shaft 50 has opposed first and second ends. A first hand grip 52 is provided on a first end of the shaft 50. A U-shaped formation 54 is provided along an intermediate portion of the shaft 50 and a second hand grip 56 is disposed around the central area of the U-shaped formation 54. The second end of the shaft 50 is bent, forming a bent-shaft portion 58, i.e. the bent shaft adaptor, which is configured to engage with the U-shaped actuator coupler 30.

The diameter of the bent-shaft portion 58 should be slightly less than the diameter of the circular apertures 36 formed in the side plates 34 to facilitate ease of engagement. The bent-shaft portion 58 should have a length B (see FIG. 3) which is slightly longer than the width A of the U-shaped actuator (see FIG. 2) to prevent the bent-shaft portion 58 from becoming inadvertently disengaged from the U-shaped actuator coupler 30 while operating the jack.

During use, an operator inserts the bent-shaft adaptor 58 through one or both of the circular apertures 36. The operator then grasps the first hand grip 52 with one hand and the second hand grip 56 with the other. Thereafter, the operator then rotates the bent-shaft handle in a desired rotational direction which, in turn, rotates the U-shaped actuator coupler thereby raising or lowering the jack, as desired, depending upon the direction of rotation.

One major inconvenience associated with jacks requiring rotational actuation movement is that an operator generally has to turn the actuator coupler 14 a significant number of revolutions. This is because such jacks, by their very nature and advantage, convert energy inputted over a relatively long period of time (via the jack handle being rotated by an operator and the jack's internal gear mechanism) into a substantial upward raising or lowering force. Thus, for example, a driver changing a flat tire will have to rotate the jack handle for quite a long period of time (e.g. 20 second to a few minutes or so) before the automobile is sufficiently raised or lowered.

This problem is even more pronounced if multiple jacks are involved in a particular application. For example, to lift a camper on or off a truck bed or to level or stabilize a recreational vehicle, one jack is positioned adjacent each corner of the camper or recreational vehicle. The operator then sequentially operates each of the four jacks via appropriate handle movement until the camper or recreational vehicle is sufficiently elevated, leveled and/or stabilized. To ensure that the camper or recreational vehicle remains substantially level at all times, each jack is only raised or lowered a small distance at one time, e.g. only raised or lowered a fractionally distance of the total distance to be traveled. Thus, not only does the operator have to move the jack handle from jack to jack, but the total time spent involved in rotating the handle to raise or lower all the associated jacks can be several minutes or so.

SUMMARY OF THE INVENTION

Wherefore, it is an object of the present invention to overcome the aforementioned problems and drawbacks associated with the prior art designs.

Another object of the present invention is to provide a jack handle, for use with jacks requiring rotational actuation movement, that can be rotated via an electric or pneumatic device, such as an electrically powered or battery operated drill or the like, e.g. a ratchet type or impact type drive device.

Another object of the present invention is to provide a jack handle that can be used very quickly and easily to shorten the time span for raising or lowering a desired object, such as a camper or recreational vehicle, via a plurality of spaced apart jacks.

Another object of the present invention is to provide a jack handle for use with jacks requiring rotational actuation.

Still another object of the invention is to provide a jack handle having a length which can be readily increased or decreased via a plurality of interconnectable and lockable extension members.

The jack handle according to the invention consists of a cylindrical shaft, preferably made of metal. The shaft has a first end portion and a second end portion. The first end portion of the shaft is provided with a drill adaptor, which is dimensioned to fit into or receive an electric or pneumatic drill head, e.g. having a dimension of between about ⅛ and about ⅜ of an inch. The second end portion of the shaft supports a bent-shaft adaptor, which is a portion of shaft that has been bent at an angle away from a longitudinal axis of the shaft.

During use, the bent-shaft portion is inserted into a U-shaped actuator coupler. The drill adaptor end is inserted and secured in a drill head, in a conventional manner, and the drill is operated to rotate the jack handle in a desired rotational direction, i.e. either clockwise or counter-clockwise to thus raise or lower the jack. The jack handle may also be provided with a square, a hexagonal, a hooked or a T-shaped adaptor end.

The present invention relates to a jack handle to facilitate operation of a jack, the jack handle comprising: an elongate shaft having a first end portion and a second opposed end portion, and the elongate shaft defining a longitudinal axis of the jack handle; a drill adaptor being integrally formed at the first end portion of the shaft to facilitate engagement with a drill to supply rotational energy to the jack handle; and an actuator coupler adaptor being integrally formed at the second end portion of the shaft to facilitate engagement with a desired jack for conveying the supplied rotational energy to the jack.

The present invention also relates to the method of manufacturing a jack handle comprising the steps of: providing an elongate cylindrical shaft having a first end portion and an opposed second end portion, with the elongate cylindrical shaft defining a longitudinal axis of the jack handle; forming a drill adaptor at the first end portion of the shaft; and forming an actuator coupler adaptor at the second end portion of the shaft.

The present invention finally relates to a method of actuating a jack having a rotational actuation mechanism and an actuator coupler, the method comprising the steps of: providing a drill with a drill head; providing a jack handle having an actuator coupler adaptor end portion and a drill adaptor end portion; securing the drill adaptor end portion of the jack handle to the drill head of the drill such that the jack handle is axially aligned with the drill; coupling the actuator coupler adaptor end portion of the jack handle to an actuator coupler of a jack; and operating the drill to supply rotational energy to the jack handle which, in turn, supplies the rotational energy to the jack via the actuator coupler of a jack, to operate the jack as desired.

BRIEF DESCRIPTION OF THE DRAWINGS

The invention will now be described, by way of example, with reference to the accompanying drawings in which.

DESCRIPTION OF THE PREFERRED EMBODIMENTS

Figure 4:
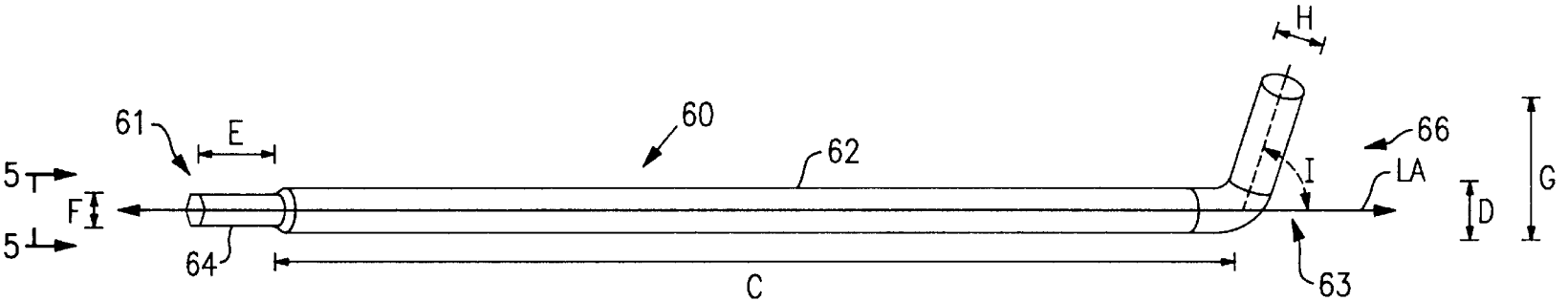
FIG. 4 is a diagrammatic perspective view of a jack handle according to the present invention.

Turning now to FIG. 4, a detailed description concerning the present invention will now be provided. As seen in FIG.

4, the jack handle 60 according to the present invention consists of a solid cylindrical shaft 62 having a length dimension of about 11" (dimension C) and a transverse dimension or diameter of about ½" or so (dimension D). Preferably the shaft is manufactured from a metal such as carbon steel or stainless steel or a material such as titanium. Alternatively, the shaft is manufactured from other known strong but durable materials such as plastic, fiberglass, or epoxy-resinated carbon fiber.

Figure 5:
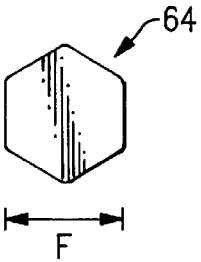
FIG. 5 is a diagrammatic end view, along section line 5—5 of FIG. 4, of the drill adaptor end portion.

The shaft 62 has a first end portion 61 and an opposed second end portion 63 (with the "end portion" being defined as the area of the shaft proximate to the shaft end, e.g. the region about 0"–2" from the end of the shaft). The first end portion 61 of the shaft is provided with a drill adaptor 64 which has an axial length of about 1" (dimension E) and is hexagonally shaped (see FIG. 5) with a transverse dimension of about ¼ to about ⅜ (dimension F) which is sized to fit readily into and be connected with a conventional electric or pneumatic drill head and be rotated therewith without any slippage therebetween.

The second end portion 63 of the shaft 62 is provided with an actuator coupler adaptorwhich, in one embodiment, is a bent-shaft adaptor 66 having an axial length of about 1" (dimension G) and has a transverse diameter of about ½ "(dimension H). To form the bent-shaft adaptor 66, the second end portion 63 of the shaft is bent at an angle of about 80° to about 90° (angle I) relative to the longitudinal axis LA of the jack handle 60.

Figure 1:
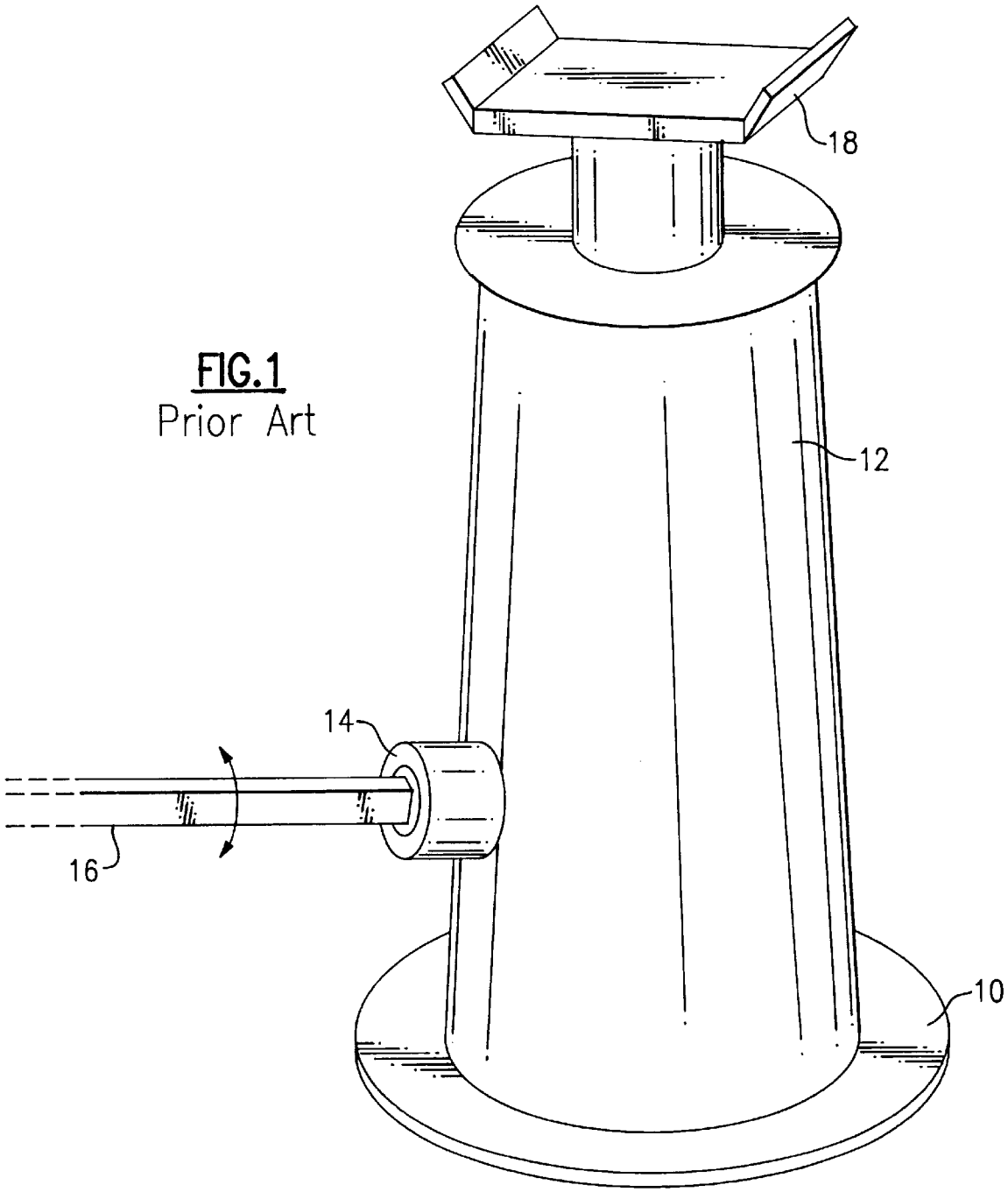
FIG.1 Prior Art
FIG. 1 is a diagrammatic perspective view of a prior art jack.
Figure 6:
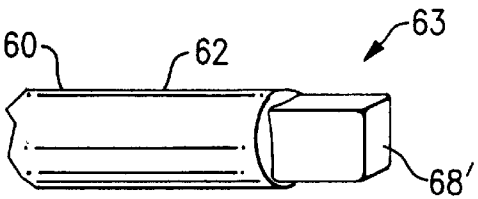
FIG. 6 is a diagrammatic partial perspective view of a square-shaft end portion adaptor, according to a second embodiment of the present invention, for use with a jack having a square female actuator coupler.

Turning now to FIG. 6, an alternative actuator coupler adaptor for the jack handle 60 is shown. As seen in FIG. 6, the second end portion 63 of the shaft 62 is machined, cast or otherwise formed to be a male square adaptor 68', instead of being a bent-shaft adaptor. As such mechanical machining, formation or manufacturing features are well known to those skilled in this art, a further detailed description concerning the same is not provided. The jack handle 60, provided with this square adaptor 68', can be used with jacks provided with a square female recess or actuator coupler (for example, actuator coupler 14 in FIG. 1) instead of a U-shaped actuator coupler.

Figure 7:
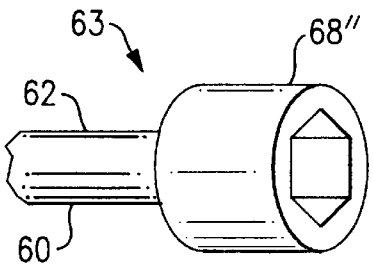
FIG. 7 is a diagrammatic partial perspective view of a hexagonal shaped end portion adaptor, according to a third embodiment of the present invention, for use with a jack having a mating hexagonal shaped female actuator coupler.

Turning now to FIG. 7, a further alternative actuator coupler adaptor for the jack handle 60 is shown. As seen in FIG. 7, the second end portion is machined, cast or otherwise formed to have a female hexagonal shaped recess adaptor 68", instead of being a bent-shaft adaptor. As such mechanical machining, formation or manufacturing features are well known to those skilled in this art, a further detailed description concerning the same is not provided. The jack handle 60, provided with the female hexagonal shaped recess adaptor 68", can be used with jacks provided with a hexagonal shaped male actuator coupler (not shown).

Figure 8:
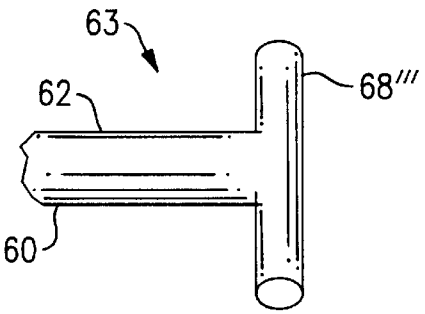
FIG. 8 is a diagrammatic partial perspective view of a T-shaped end portion adaptor, according to a fourth embodiment of the present invention, for use with a jack having a mating T-shaped female actuator coupler.

Turning now to FIG. 8, a further alternative actuator coupler adaptor for the jack handle 60 is shown. As seen in FIG. 8, the second end portion is machined, cast or otherwise formed to be a male T-shaped end portion adaptor 68'". As such mechanical machining, formation or manufacturing features are well known to those skilled in this art, a further detailed description concerning the same is not provided herein. The jack handle 60, provided with the male T-shaped end portion adaptor 68'", can be used with jacks provided with a T-shaped or slotted female recess or actuator coupler (not shown).

Figure 9:
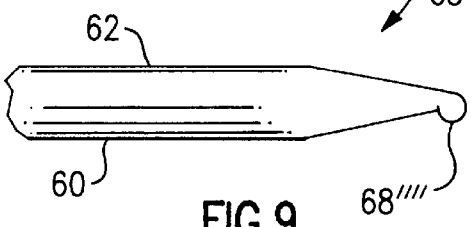
FIG. 9 is a diagrammatic partial perspective view of a nub-shaped end portion adaptor, according to a fifth embodiment of the present invention, for use with a jack having a mating nub-shaped female actuator coupler.

A further alternative actuator coupling adaptor, for use with a jack handle according to the present invention, as shown in FIG. 9. As seen in this Figure, the second end portion 63 is machined, cast or otherwise formed to be a substantial planar shaped, male member having a nub-shaped end portion adaptor 68"". As such mechanical machining formation or manufacturing features are well known to those skilled in the art, a further detailed description concerning the same is not provided. The jack handle 60, provided with the nub-shaped end portion adaptor 68"", can be used with jacks provided with a nub-shaped or slotted female recess or actuator coupler (not shown).

The nub 69, of the nub-shaped end portion adaptor 68"", facilitates a locking engagement between the second end portion 63 of the jack handle 60 and the nub-shaped or slofted female recess of the jack. To provide the locking engagement, the longitudinal axis LA of the jack handle 60 is aligned at an angle, e.g. an angle of between about 90° and 150° or so, with respect to the longitudinal axis of the female recess or actuator coupler. Thereafter, slight relative movement, e.g. about ⅛" to about ½ or so, between those two components is provided to achieve the locking engagement between the nub-shaped end portion adaptor 68"" and the female recess or actuator coupler of the jack. Once this has occurred, the longitudinal axis LA of the jack handle 60 is aligned with the longitudinal axis of the female recess or actuator coupler of the jack to facilitate operation of the jack. To disconnect these two components from one another, the procedure is merely reversed.

Figure 2:
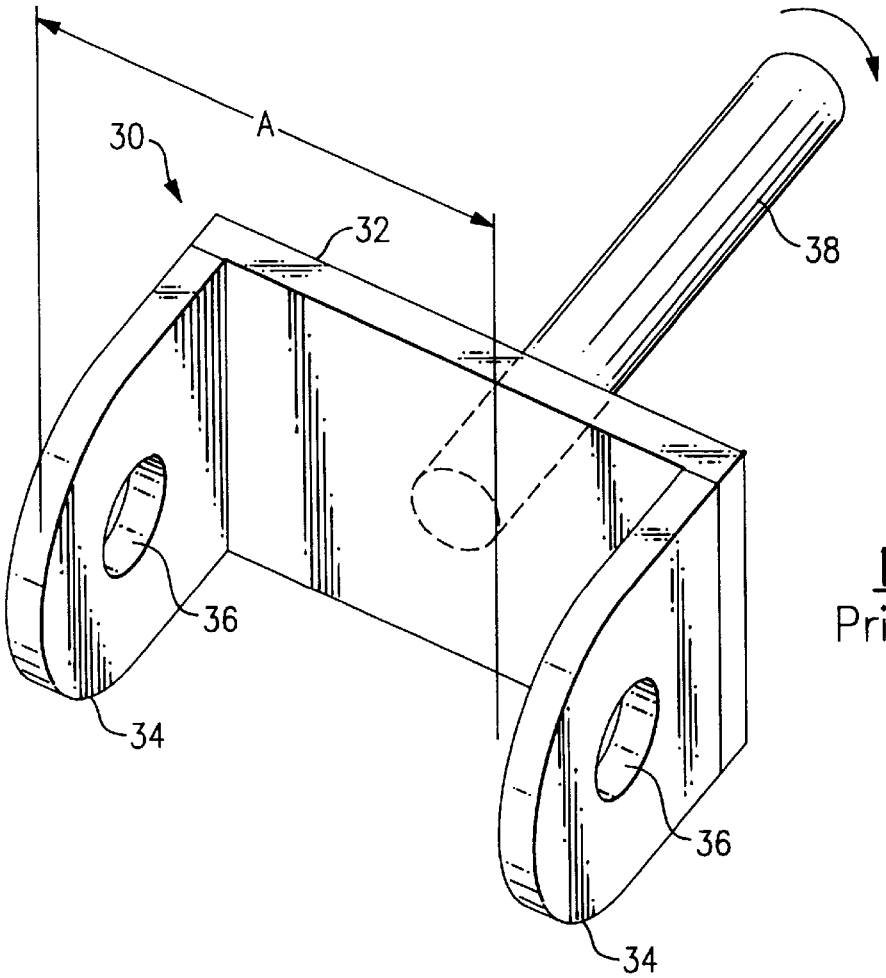
FIG.2 Prior Art
FIG. 2 is a diagrammatic perspective view of a prior art U-shaped jack actuator coupler.
Figure 3:
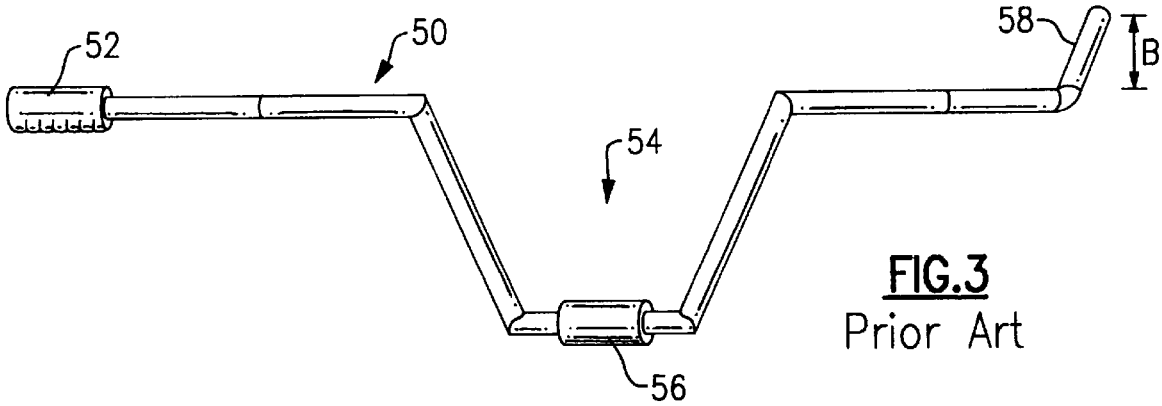
FIG.3 Prior Art
FIG. 3 is a diagrammatic side elevational view of a priolart jack handle.

During use, the adaptor 66 is inserted, for example, into an actuator coupler such as the one shown in FIG. 2. For a jack handle outfitted with either a male square adaptor 68', a male hexagonal shaped adaptor 68", a male T-shaped adaptor 68'", or a male nub-shaped adaptor 68"", the respective adaptor end portion 68, 68', 68", 68'",68"" is simply inserted in the corresponding female actuator coupler, as noted above. Then, the drill adaptor end 64 of the jack handle 60 is inserted and secured in a drill head (not shown), using the conventional tightening mechanism of the drill, with the drill rotational axis and the longitudinal axis LA of the jack handle 60 being aligned with one another. Finally, the drill is operated, in a conventional manner, to rotate the jack handle at a desired rotational speed and in desired rotational direction to either raise or lower the jack.

Figure 10:
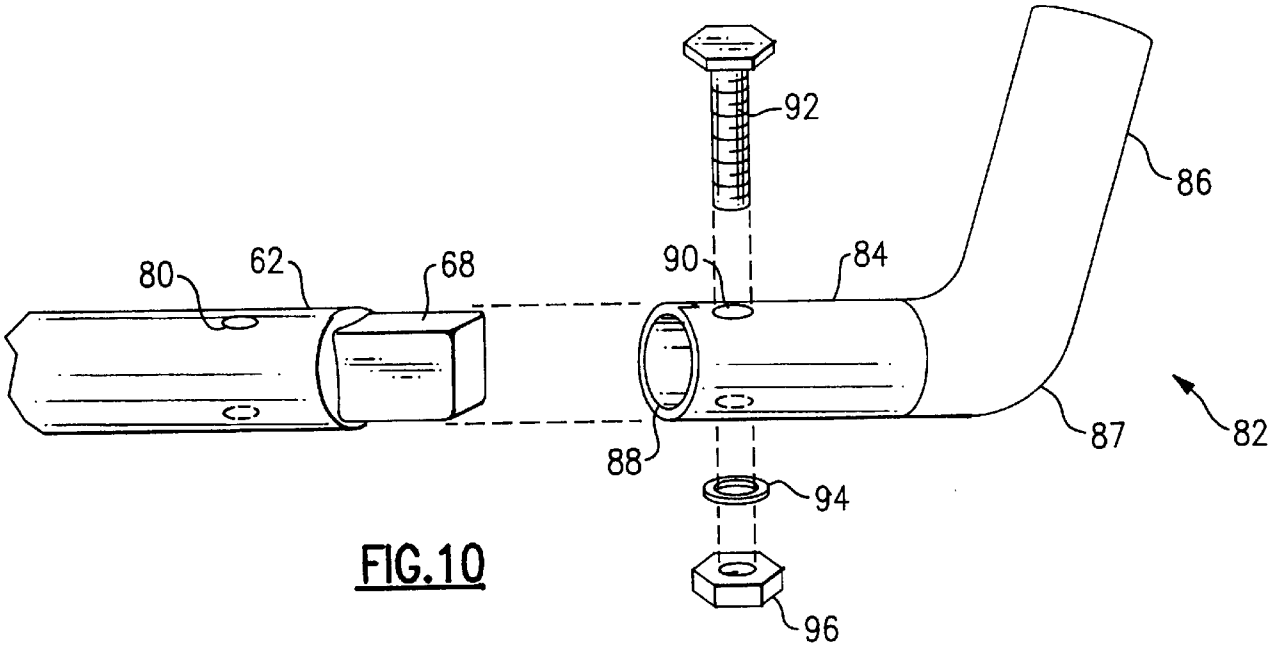
FIG. 10 is a diagrammatic enlarged perspective view of a sixth embodiment according to the present invention.

FIG. 10 shows a sixth embodiment of the jack handle according to the present invention. As seen in FIG. 10, the second end portion 63 of the shaft 62 is provided with a square adaptor 68, as with the embodiment of FIG. 6. However, at a location between the square adaptor 68 and the shaft end area adjacent the square adaptor 68, a through bore 80 extends radially through the shaft 62.

A bent-shaft sleeve 82 is provided as an additional component. The bent shaft sleeve 82 has a first straight section 84, for receiving the square adaptor 68', and a second straight section 86 being connected with the first straight section 84 via a bent transition section 87. The first straight section 84 is hollow so as to form a cylindrical axially opening therein, which may or may not extend axially to the bent transition section 87. The cylindrical aperture 88 has a diameter slightly larger than the diameter of the shaft 62 (dimension D). Here, "slightly larger" means that the bent-shaft sleeve should be able to fit over and encase the shaft 62 as snugly or tightly as possible, without requiring more than unaided human force, but to provide secure coupling of the two components to one another.

The bent-shaft sleeve 82 also has a through bore 90 provided along the first straight section 84 which is provided with a conventional removable fastening mechanism, e.g. a bolt 92, a washer 94, and a nut 96. The bent-shaft sleeve 82 and removable fastening mechanism are collectively referred to as the bent-shaft sleeve assembly.

If an operator desires to use the jack handle with the square adaptor 68', the bent-shaft sleeve 82 and fastening mechanism are not utilized. However, if the operator desires to use the jack handle with the bent-shaft sleeve 82 (thus providing a bent-shaft adaptor), the operator slips the bent-shaft sleeve 82 over the second end portion 63 of the shaft 62. The size of the cylindrical aperture 88 and the positioning of the through bores 80, 90 should be coordinated such that the through bores 80, 90 align with one another. The operator then secures the bent-shaft sleeve 82 to the shaft 62 using the fastening mechanism, for example, inserting the bolt 92 through both bores 80, 90 such that the inserted end of the bolt 92 protrudes out through the two bores 80, 90, and then the washer 94 is positioned over the protruding portion of the bolt 92, and finally the nut 96 is threaded thereon.

Alternatively, it is to be appreciated that the removable fastening mechanism could be a cotter pin or a set screw, or any other conventional fastening device well known in the art. If a set screw arrangement is implemented, through bore 80 is optional, and the through bore 90 is a single hole in the wall of the first straight section 84 which is provided with a suitable thread to engage with the set screw.

Figure 11:
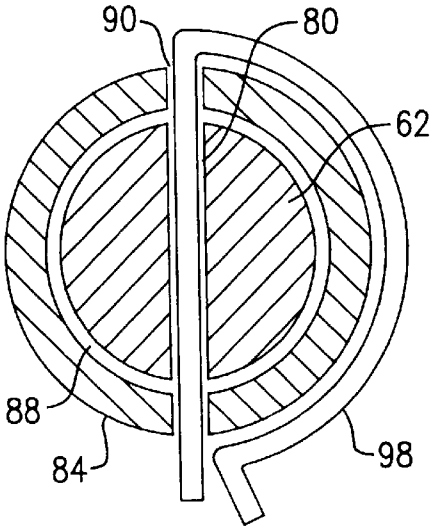
FIG. 11 is a diagrammatic cross sectional view of the embodiment of FIG. 10 with an alternative temporary fastening mechanism.

Turning now to FIG. 11, a cross-sectional view of the bent shaft sleeve assembly in use with a cotter pin 98, as the temporary fastening mechanism, is shown. The cotter pin 98 is specially shaped to accommodate the radius of the bent-shaft sleeve first straight section 84. Of course, the cotter pin 98 must be flexible enough to readily allow its insertion and removal from the aligned bores 80, 90.

Figure 12:
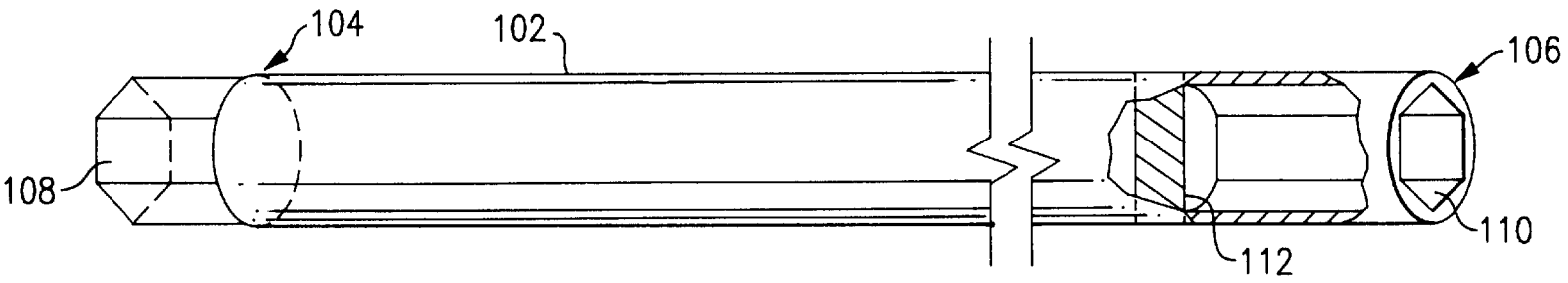
FIG. 12 is a diagrammatic partial perspective view of an extension member, shown partially in cross sectional, according to the present invention.

With reference to FIG. 12, a detailed description concerning an extension member 102, according to the present invention, will now be provided. The extension member 102 has a first end section 104 and an opposed second end section 106 (with the "end section" being the area of the extension member proximate to the extension member end, e.g. the region about 0"–2" from the end of the extension member). The first end section 104 of the extension member 102 is provided with a drill adaptor 108, similarly or identically shaped to the drill adaptor 64 of the jack handle 60, e.g. the drill adaptor 108 has an axial length of about 1" and is hexagonally shaped with a transverse dimension of ¼ to ⅜ that is sized to fit readily into and connected with a conventional electric or pneumatic drill head and be rotated therewith without any slippage therebetween.

The second end section 106 of the extension member 102 is provided with a hexagonally shaped recess 110 which has a depth of about 1" and has transverse diameter opening of about ¼ to about ⅜ inches. The hexagonally shaped recess 110 is sized to intimately receive the drill adaptor 108 of another identical extension member 102 or the drill adaptor 64 of the shaft 62 of the jack handle 62, for example, to increase of decrease the overall length of the jack handle 60 as desired.

A magnet 112 is secured within the hexagonally shaped recess 110, e.g. at a distance of at least 1 inch away from an end face of the extension member 102 accommodating the hexagonally shaped recess 110. The magnet provides a quick connect/disconnect coupling, i.e. via magnetic attraction, to either the drill adaptor 108 of another identical extension member 102 or the drill adaptor 64 of the shaft 62, for example. It is to be appreciated that other type of well known quick connect/disconnect couplings, e.g. a spring biased detent engaging with an annular recess formed in the coupled member, etc., could also be employed without departing from the spirit and scope of the present invention.

Figure 13:
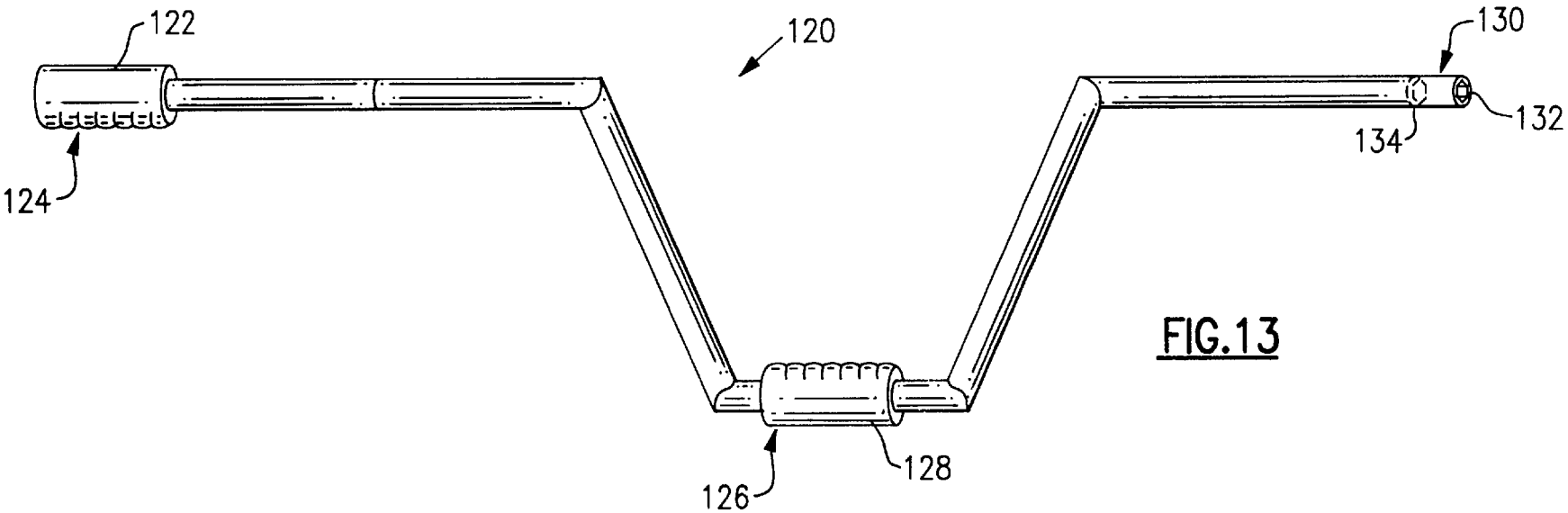
FIG. 13 is a diagrammatic perspective view of a jack handle extension member according to the present invention.

Turning now to FIG. 13, a quick connect/disconnect extension handle 120, for use with the present invention, is diagrammatically shown. The extension handle 120 has a first hand grip 122 provided on a first end 124 thereof. A U-shaped formation 126 is provided along an intermediate portion of the extension handle 120 and a second hand grip 128 is disposed around the central area of the U-shaped formation 126. The second end of the shaft 130 is provided with a hexagonally shaped recess 132 which has a depth of about 1" and has a transverse diameter opening of about ¼ to about ⅜ inches. The hexagonally shaped recess 132 is sized to intimately receive the drill adaptor 108 of an extension member 102 or the drill adaptor 64 of the shaft 62, for example, to readily adjust, i.e. increase or decrease, the overall length of the jack handle 60 as desired.

A magnet 134 is secured within the hexagonally shaped recess 132, e.g. at a distance of at least 1 inch away from an end face of the extension handle 120 accommodating the hexagonally shaped recess 132. The magnet 134 provides a quick connect/disconnect coupling to either the drill adaptor 108 of an extension member 102 or the drill adaptor 64 of the shaft 62, for example. It is to be appreciated that other type of well known quick connect/disconnect couplings could also be employed within the hexagonally shaped recess 132 of the extension handle 120 without departing from the spirit and scope of the present invention.

Figure 14:
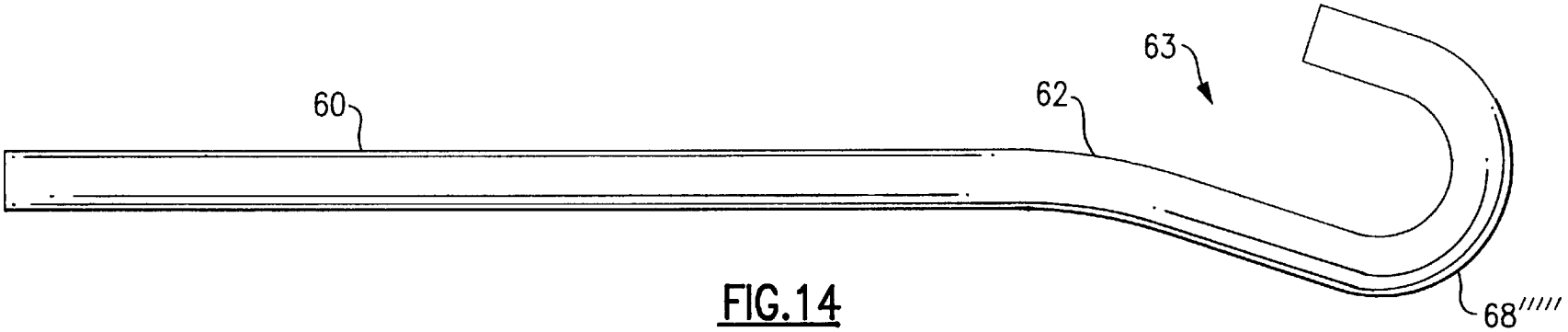
FIG. 14 is a diagrammatic partial perspective view of a hook-shaped end portion adaptor, according to a sixth embodiment of the present invention, for use with a jack having a mating hook-shaped female adaptor coupler.

Turning now to FIG. 14, a further alternative actuator coupler adaptor for the jack handle 60 is shown. As seen in this Figure, the second end portion is machined, cast, bent, or otherwise formed into a hook-shaped end portion adaptor 68''''. As such mechanical machining, formation, bending or manufacturing features are well known to those skilled in this art, a further detailed description concerning the same is not provided herein. The jack handle 60, provided with the male hook-shaped end portion adaptor 68'''', can be used to connect to a jack provided with a mating female actuator coupler (not shown), e.g. a female hook-shaped actuator coupler.

Figure 15:
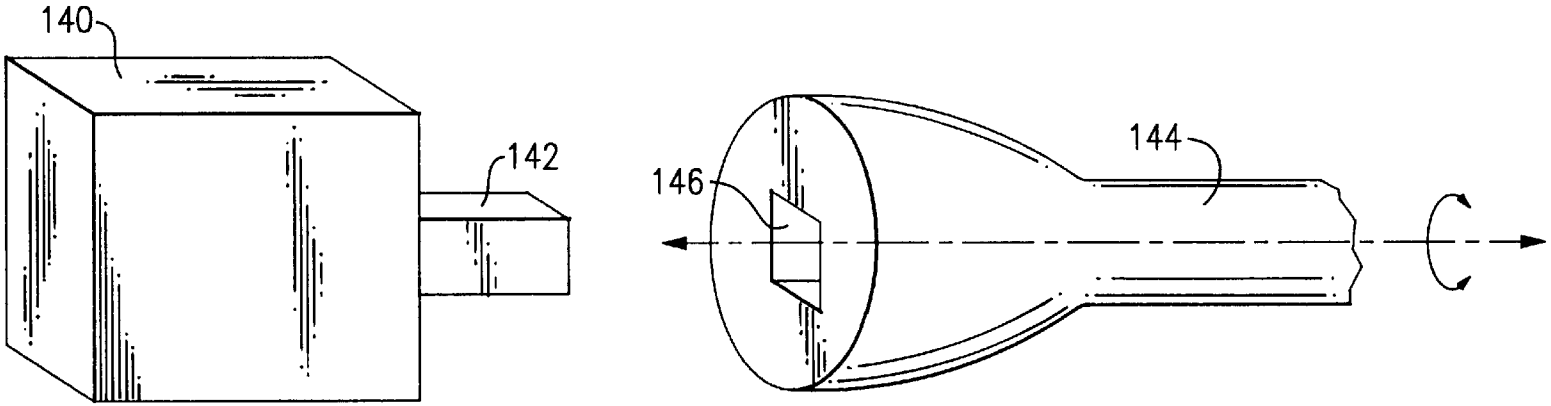
FIG. 15 is a diagrammatic view showing an electric drive device, having a male adaptor for engagement with a jack handle having a mating female shaped square recess.

With reference to FIG. 15, a further embodiment of the present invention will now be briefly discussed. According to this embodiment, a portable drive device 140, e.g. a battery-operated drill or the like, is provided with a male adaptor 142. According to this embodiment, the male shaped adaptor 142 is square and has an axial length of about 0.51 to about 3 inches or so to facilitate engagementwith a desired jack handle 144. Since the portable drive device 140 carries a male adaptor 142, the mating end of the jack handle 144 is configured to have a mating female shaped recess 146, e.g. a female recess which has a depth of about 0.5 to about 3 inches or so to facilitate secure engagement with the male adaptor 142 of the portable drive device 140. Due to this arrangement, as the drive device is rotated, the rotational drive is transmitted from the male adaptor 142 to the female adaptor recess 146 and along the jack handle 144 to the opposed end of the jack handle 144 (not shown in this drawing). From there, the jack handle 144transmit the imputed rotational drive to the associated jack for raising or lowering the jack.

Although the jack handle of the present invention is illustrated as having particular dimensions, one of ordinary skill in the art will appreciate that differing dimensions (e.g. a thicker rod, a longer bent-shaft portion, a longer or short length, a plurality of extension members, etc.) could be used without departing from the spirit and scope of the invention. Furthermore, although the jack handle drill adaptor is shown as being either hexagonal, square, bent, etc., one of ordinary skill in the art will appreciate that other shapes such as a triangular, a square, a pentagonal, a hexagonal, an octagonal, etc., could be utilized without departing from the spirit and scope of the present invention.

Also, although the jack handle is illustrated as being a solid shaft, one of ordinary skill in the art will appreciate that a hollow shaft could be utilized, to save manufacturing costs, without departing from the spirit and scope of the invention, provided that the shaft material has sufficient strength to allow actuation of the desired jack.

Since certain changes may be made in the above described jack handle, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A jack handle for facilitating operation of a jack, the jack handle comprising:

an elongate shaft having a first end portion and a second opposed end portion, and the elongate shaft being a single piece unitary shaft and defining a longitudinal axis of the jack handle, and the elongate shaft having an axial length of about 11 inches;

a drill adaptor being integrally formed at the first end portion of the shaft to facilitate engagement with a drill to supply rotational energy to the jack, the drill adaptor being hexagonally shaped and having an axial length of about 1 inch; and an actuator coupler adaptor being integrally formed at the second end portion of the shaft to facilitate engagement with a desired jack for conveying the supplied rotational energy to the jack, the actuator coupler adaptor comprising a bent-shaft portion having an axial length of about 1 inch, and the bent-shaft portion being bent at an angle between about 80° to about 90° relative to the longitudinal axis of the jack handle.

2. The jack handle according to claim 1, wherein the angle of the bent-shaft portion, relative to the longitudinal axis of the jack handle, is about 80°.

3. A jack handle for facilitating operation of a jack, the jack handle comprising:

an elongate shaft having a first end portion and a second opposed end portion, and the elongate shaft being a single piece unitary shaft and defining a longitudinal axis of the jack handle, and the elongate shaft having an axial length of about 11 inches and a transverse dimension of about ½ inch;

a drill adaptor being integrally formed at the first end portion of the shaft to facilitate engagement with a drill to supply rotational energy to the jack, the drill adaptor being hexagonally shaped and having an axial length of about 1 inch and a transverse dimension of between about ¼ inches to about ⅜ inches;

an actuator coupler adaptor being integrally formed at the second end portion of the shaft to facilitate engagement with a desired jack for conveying the supplied rotational energy to the jack, the actuator coupler adaptor comprising a bent-shaft portion having an axial length of about 1 inch and a transverse dimension of between about ½ inch, and the bent-shaft portion being bent at an angle of 80° relative to the longitudinal axis of the jack handle; and the elongate shaft, the drill adaptor and the actuator coupler adaptor all being formed from one of carbon steel, stainless steel and titanium.

* * * * *